US007918506B2

(12) United States Patent
Hsiao

(10) Patent No.: US 7,918,506 B2
(45) Date of Patent: Apr. 5, 2011

(54) PADDING STRUCTURE FOR A CHAIR

(75) Inventor: Hsueh-Sheng Hsiao, Jhuci Township, Chiayi County (TW)

(73) Assignee: Chern Shing Top Co., Ltd., Chiayi County (TW)

( * ) Notice: Subject to any disclaimer, the term of this patent is extended or adjusted under 35 U.S.C. 154(b) by 177 days.

(21) Appl. No.: 12/366,723

(22) Filed: Feb. 6, 2009

(65) Prior Publication Data

US 2010/0201168 A1 Aug. 12, 2010

(51) Int. Cl.
*A47C 3/00* (2006.01)

(52) U.S. Cl. ..... 297/284.3; 297/284.4; 297/284.9; 297/284.11

(58) Field of Classification Search ..... 297/284.4, 297/284.3, 284.1, 284.11, 284.9
See application file for complete search history.

(56) References Cited

U.S. PATENT DOCUMENTS

| | | | | |
|---|---|---|---|---|
| 3,983,640 | A * | 10/1976 | Cardullo et al. | 434/59 |
| 5,197,780 | A * | 3/1993 | Coughlin | 297/284.7 |
| 5,217,278 | A * | 6/1993 | Harrison et al. | 297/284.7 |
| 5,567,010 | A * | 10/1996 | Sparks | 297/284.4 |
| 5,567,011 | A * | 10/1996 | Sessini | 297/284.7 |
| 5,775,773 | A * | 7/1998 | Schuster et al. | 297/284.1 |
| 6,030,041 | A * | 2/2000 | Hsiao | 297/284.4 |
| 6,050,641 | A * | 4/2000 | Benson | 297/284.4 |
| 6,088,643 | A * | 7/2000 | Long et al. | 701/49 |
| 6,422,087 | B1 * | 7/2002 | Potter | 73/731 |
| 6,619,739 | B2 * | 9/2003 | McMillen | 297/284.7 |
| 6,637,817 | B1 * | 10/2003 | Christopher et al. | 297/284.4 |
| 7,137,664 | B2 * | 11/2006 | McMillen et al. | 297/284.4 |
| 7,140,680 | B2 * | 11/2006 | McMillen et al. | 297/284.9 |
| 7,770,972 | B2 * | 8/2010 | Popa | 297/284.4 |
| 2003/0006635 | A1 * | 1/2003 | Klingler | 297/284.4 |
| 2003/0164634 | A1 * | 9/2003 | Da Silva | 297/284.4 |
| 2003/0230917 | A1 * | 12/2003 | Dorfler et al. | 297/284.1 |
| 2004/0075319 | A1 * | 4/2004 | VanSickle | 297/284.4 |
| 2005/0040687 | A1 * | 2/2005 | Schuster et al. | 297/284.4 |
| 2005/0127728 | A1 * | 6/2005 | Sugiyama et al. | 297/284.3 |
| 2005/0280298 | A1 * | 12/2005 | Hsiao | 297/284.4 |
| 2006/0131938 | A1 * | 6/2006 | Moriggi | 297/284.4 |
| 2007/0057548 | A1 * | 3/2007 | Buffa | 297/284.4 |
| 2007/0236063 | A1 * | 10/2007 | Blendea | 297/284.4 |
| 2007/0267905 | A1 * | 11/2007 | Cvek | 297/284.2 |
| 2008/0018153 | A1 * | 1/2008 | Forgatsch et al. | 297/284.3 |
| 2009/0039131 | A1 * | 2/2009 | Hsiao | 226/109 |

FOREIGN PATENT DOCUMENTS

| | | | |
|---|---|---|---|
| JP | 57205238 A | * | 12/1982 |
| WO | WO 8700407 A1 | * | 12/1987 |

* cited by examiner

*Primary Examiner* — David Dunn
*Assistant Examiner* — David E Allred
(74) *Attorney, Agent, or Firm* — Alan Kamrath; Kamrath & Associates PA

(57) ABSTRACT

A padding structure for a chair includes a back support, a seat plate, a foam disposed on the back support, two guiding lines mounted on the back support, and two guiding lines mounted on the seat plate. Each guiding line of the back support and the seat plate is connected with a resilient member to control flexibility of the resilient member. An adjustable member is used to control the expansion and retraction of the guiding lines to drive the resilient members to change their radii of curvature, correcting the user's improper posture.

5 Claims, 9 Drawing Sheets

PADDING STRUCTURE FOR A CHAIR

BACKGROUND OF THE INVENTION

1. Field of the Invention

The present invention relates to a padding structure and, more particularly, to a padding structure for a chair that can completely support a user's waist and can correct improper posture.

2. Description of the Prior Art

A padding structure for a chair includes a chair back and a cushion to support a user sitting on the chair.

A conventional padding structure for a chair includes a back support and a seat plate having foam attached thereon and covered by a cloth. A user can sit on the foam and lie on the chair back, feeling comfortable. In recent years, a guiding line is used to control a resilient member which is defined between the back support and the foam to change its radii of curvature so as to bend the foam, thus supporting the user's back. However, the user's waist can not be supported by the chair back, causing fatigue.

In addition, chairs can not be adjusted for height. Therefore, the user with a tall height has to suspend his lower portions of the thighs, feeling uncomfortable.

The present invention has arisen to mitigate and/or obviate the afore-described disadvantages.

SUMMARY OF THE INVENTION

The primary object of the present invention is to provide a padding structure for a chair that can completely support a user's waist and can correct improper posture.

To obtain the above objective, a padding structure for a chair provided by the present invention includes a back support, a seat plate, a foam disposed on the back support, two guiding lines mounted on the back support, and two guiding lines mounted on the seat plate. Each guiding line of the back support and the seat plate is connected with a resilient member to control flexibility of the resilient member. Besides, an adjustable member is used to control the expansion and retraction of the guiding lines to drive the resilient members to change their radii of curvature, correcting the user's improper posture.

DETAILED DESCRIPTION OF THE PREFERRED EMBODIMENTS

Figure 1:
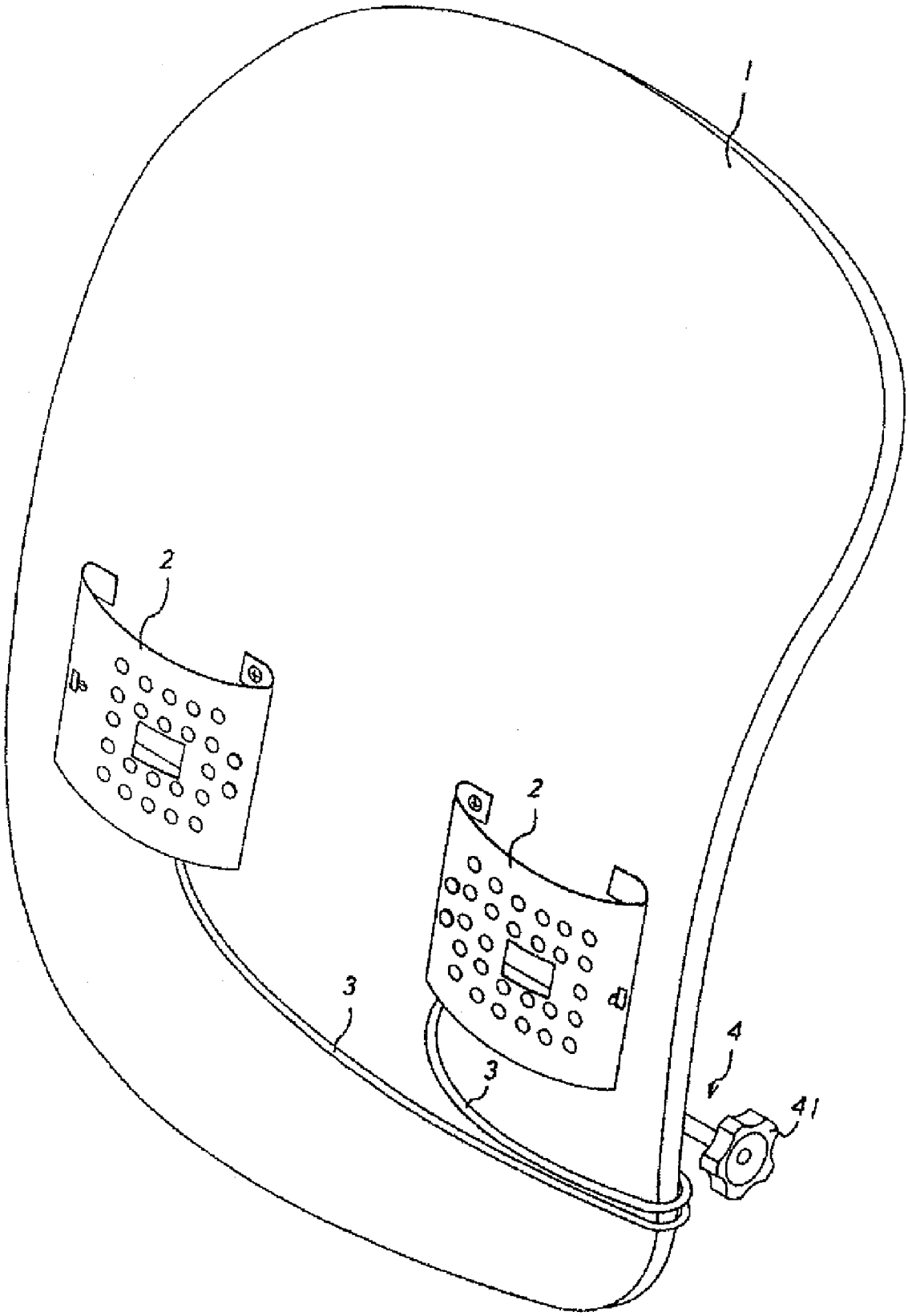
FIG. 1 is an assembly view of a padding structure for a chair in accordance with a first embodiment of the present invention.

A padding structure for a chair in accordance with the present invention includes a back support 1, a foam 5 disposed to the back support 1, and two guiding lines 3. Each guiding line 3 is mounted on the back support 1 and connected with a resilient member 2 to change a radii of curvature of the resilient member 2. As shown in FIG. 1, the foam 5 attached on the back support 1, the resilient members 2, and a cloth covered on the back support 1 are well known, accordingly further remarks are omitted. Besides, an adjustable member 4 is used to control the expansion and retraction of the guiding lines 3 so as to drive the resilient members 2 to change their radii of curvature, correcting the user's improper posture.

Figure 2:
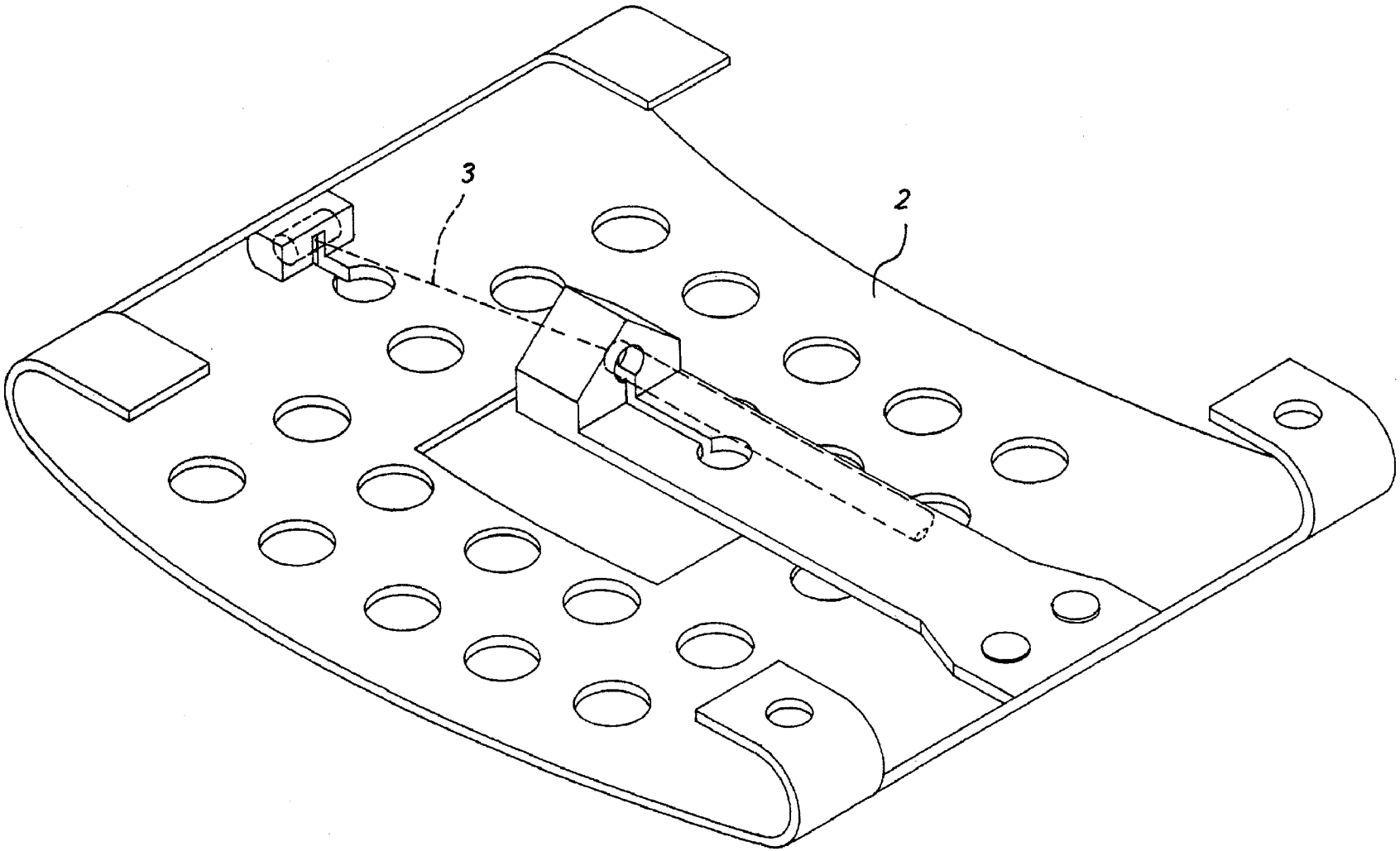
FIG. 2 is an assembly view of a resilient member in accordance with the first embodiment of the present invention.
Figure 3:
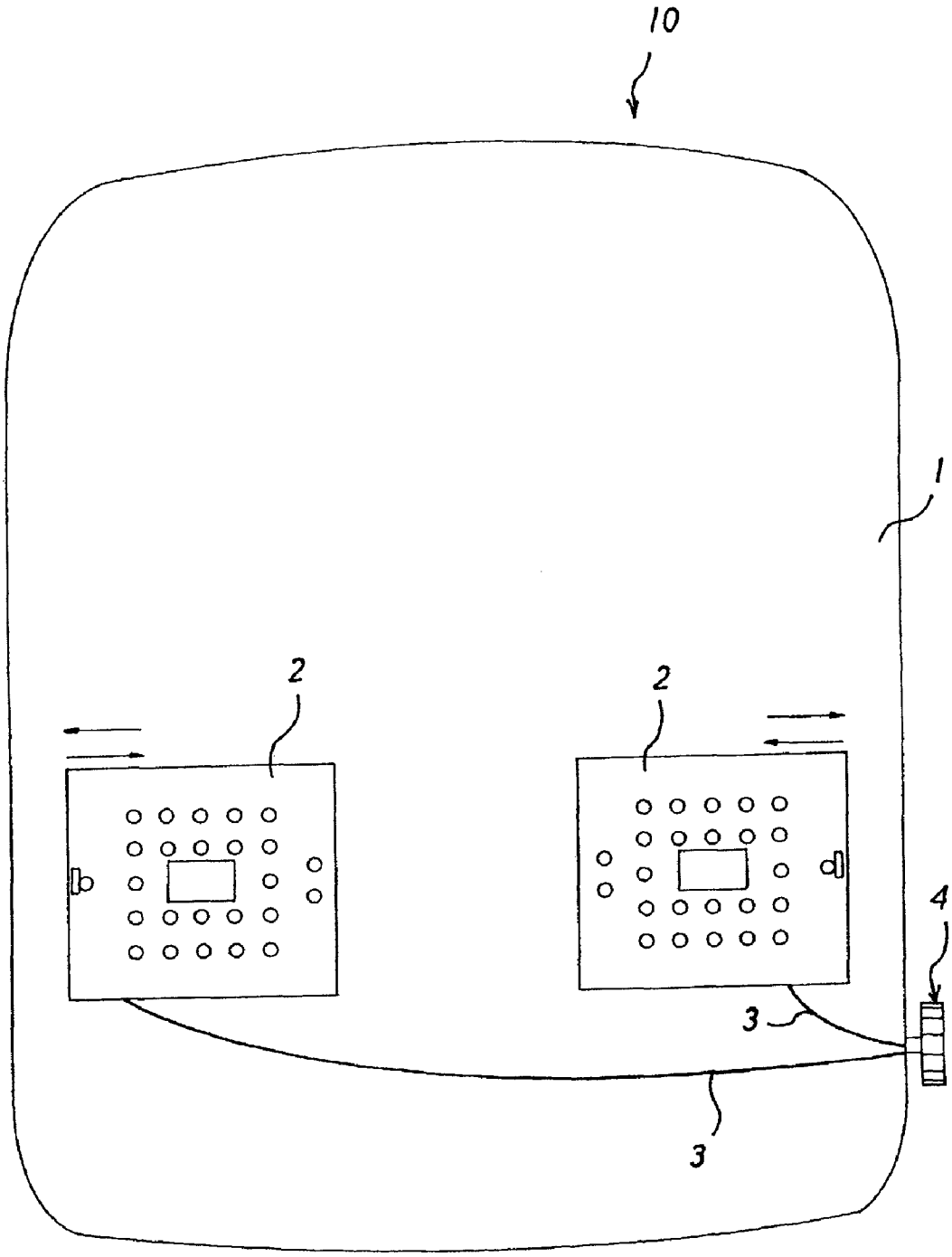
FIG. 3 is a plane view showing the operation of the padding structure for a chair in accordance with the first embodiment of the present invention.
Figure 4:
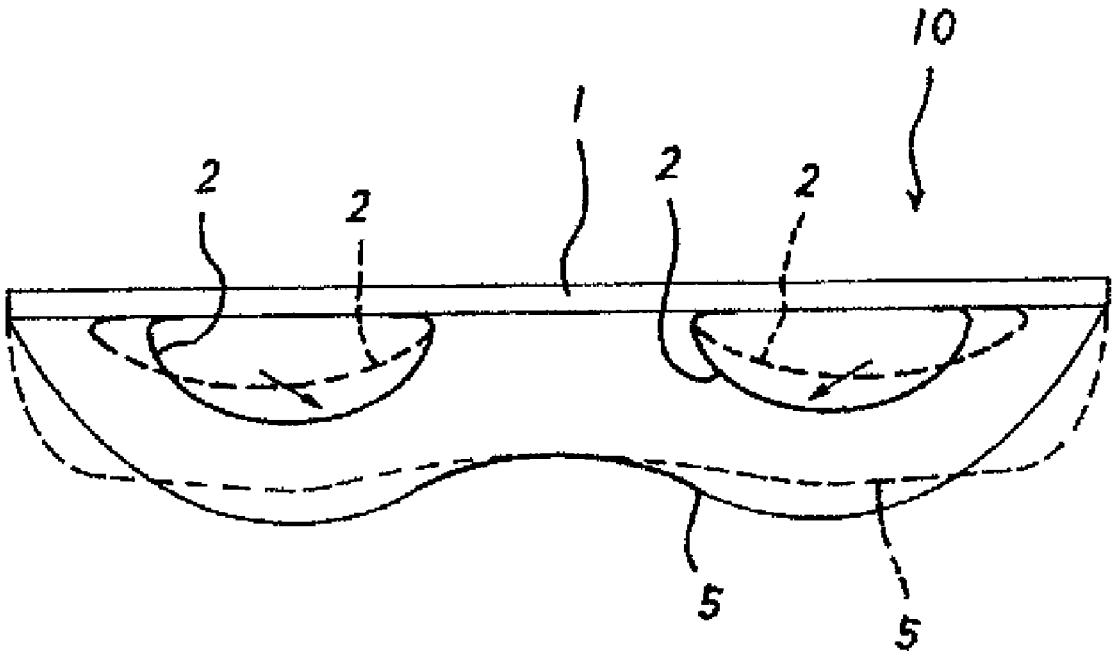
FIG. 4 is another plane view showing the operation of the padding structure for a chair in accordance with the first embodiment of the present invention.

The resilient member 2 is an arcuate flexible plate (as shown in FIG. 2), and its two ends are connected together by using the guiding line 3 to change a distance between the two ends (as illustrated in FIG. 3) of the resilient member 2, adjusting the radii of curvature of the resilient member 2. Furthermore, the resilient member 2 can contact two sides of the user's waist to adjust the resilient member 2. The adjustable member 4 can adjust the expansion and retraction of the guiding lines 3 to change the radian radii of curvature of the resilient member 2, such as becoming convexed inward or expanding outward (as shown in FIG. 4). Thereafter, the radii of curvature of the foam 5 is changed to match a width of the user's waist, thereby enabling a chair back 10 to completely support the user's waist and can correct improper posture.

Figure 5:
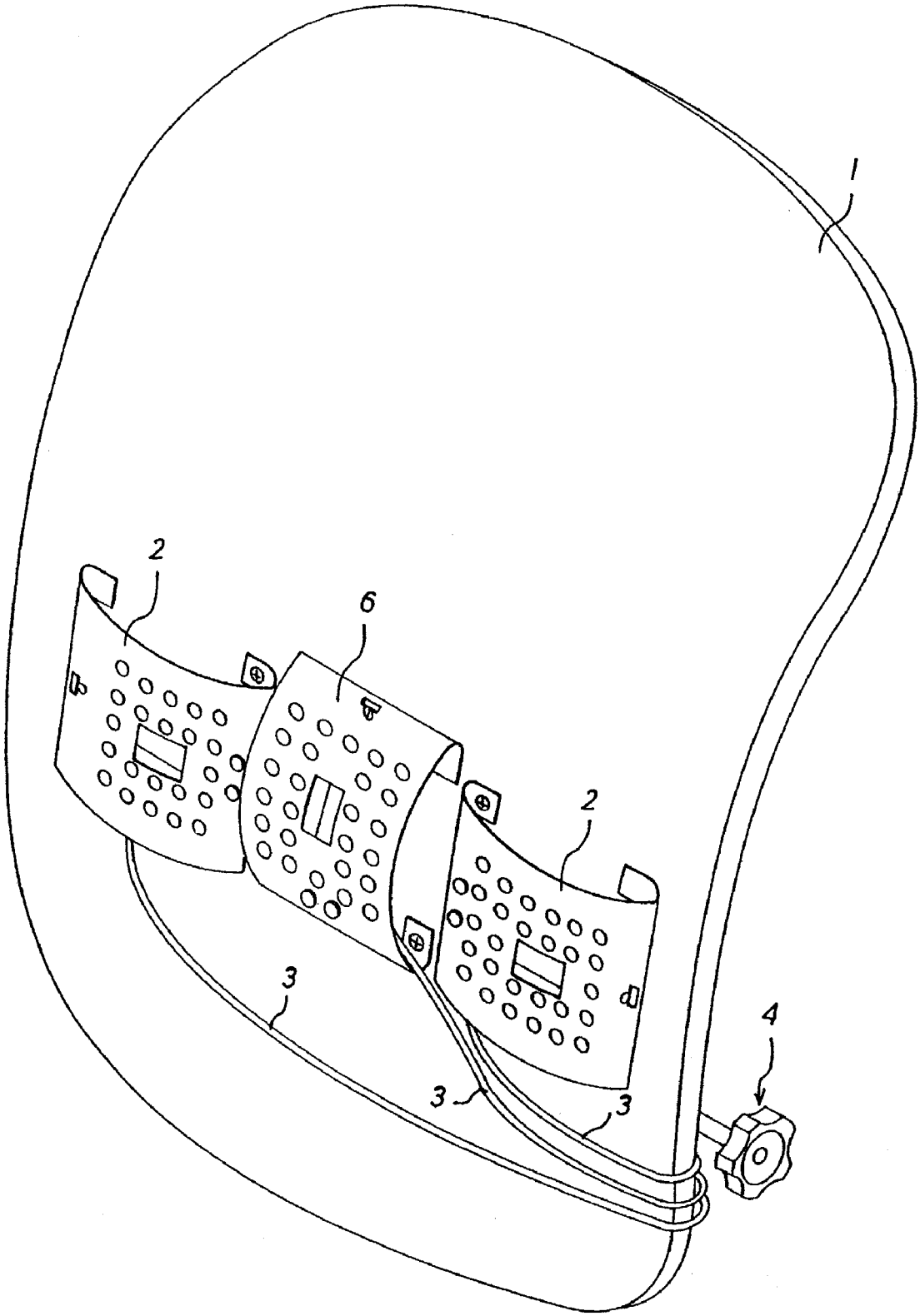
FIG. 5 is an assembly view of a padding structure for a chair in accordance with a second embodiment of the present invention.

A chair back 10 in accordance with a second embodiment of the present invention includes a longitudinal resilient member 6 (as illustrated in FIG. 5) arranged between the resilient members 2 and which can adjust its flexibility to support the user's waist and back, thus enhancing comfort of the chair back 10.

Figure 6:
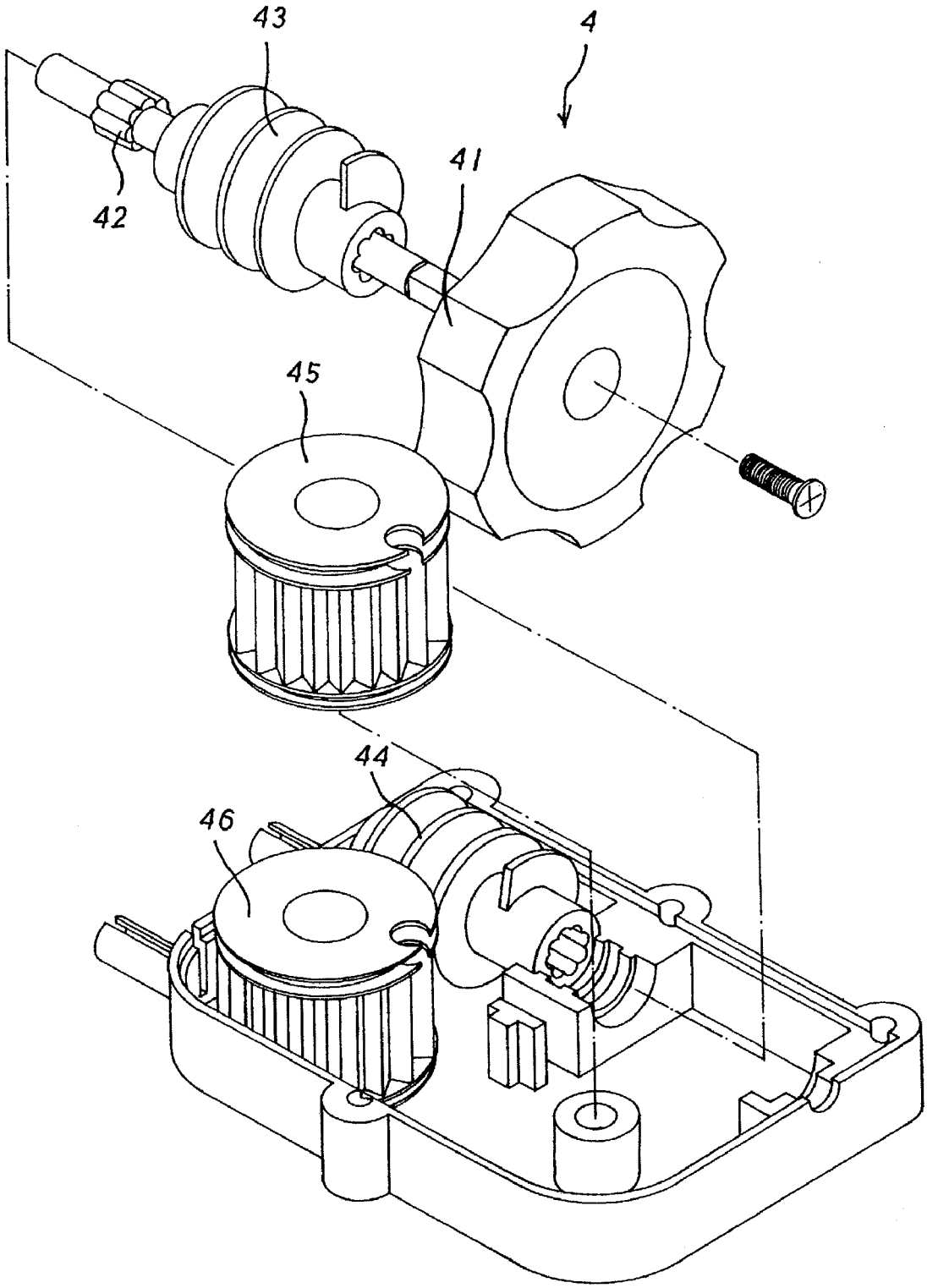
FIG. 6 is an exploded view of an adjustable member in accordance with the second embodiment of the present invention.
Figure 7:
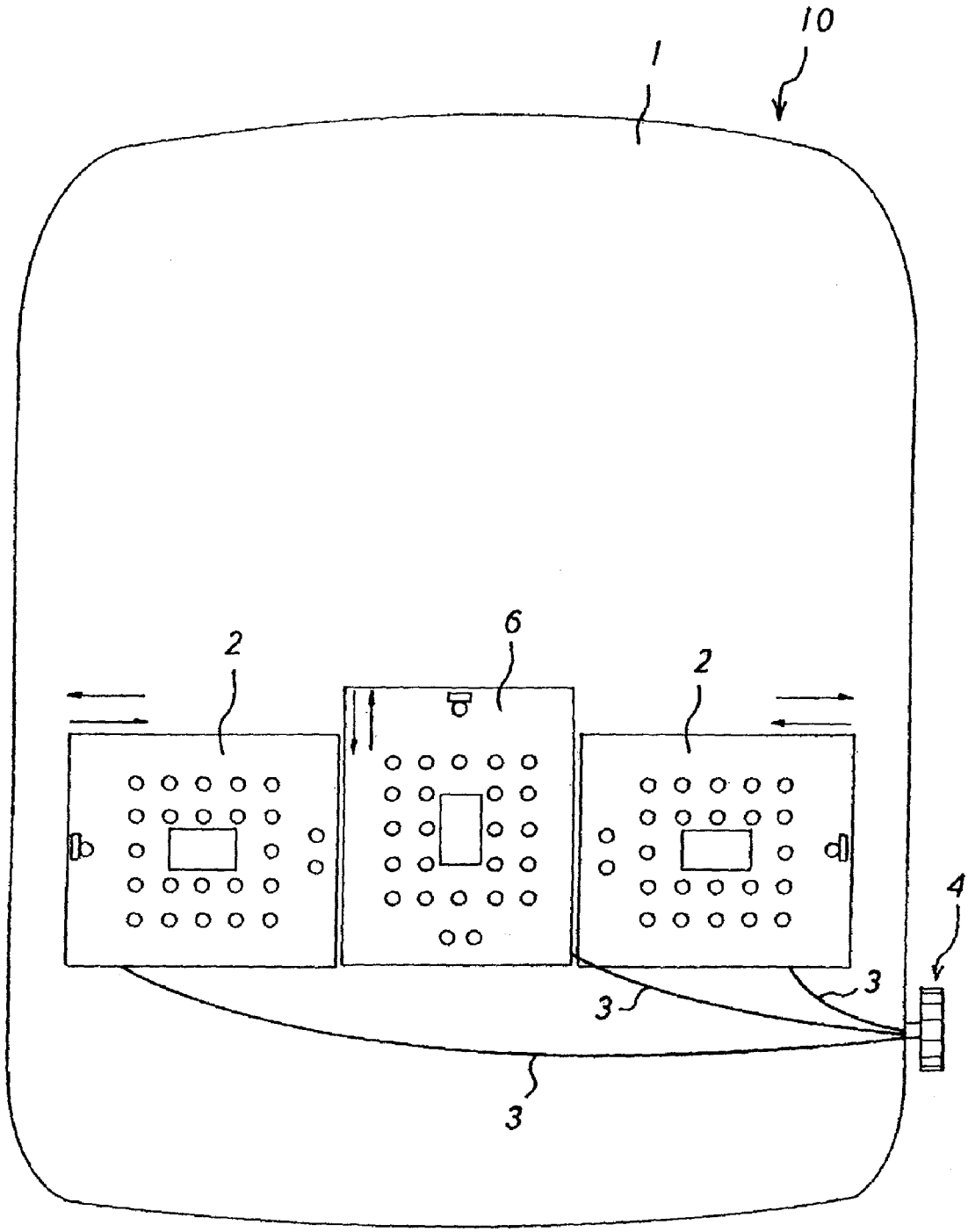
FIG. 7 is a plane view showing the operation of the padding structure for a chair in accordance with the second embodiment of the present invention.

To operate the guiding lines 3 easily, the adjustable member 4 can be provided with a rotating member 41 having a shaft member 42 selectively inserted in a first worm gear 43 or a second worm gear 44 to actuate a first toothed reel 45 or a second toothed reel 46 (as illustrated in FIG. 6). One end of each of the guiding lines 3 on the two sides of the resilient member 2 is rolled onto the first toothed reel 45, and a guiding line of the longitudinal resilient member 6 is rolled onto the second toothed reel 46 so that the first toothed reel 45 can simultaneously actuate the resilient members 2 to be adjusted. Besides, a screw is inserted to the shaft member 42 of the rotating member 41 to actuate the second toothed reel 46 so that the longitudinal resilient member 6 can be actuated to change its radian radii of curvature (as illustrated in FIG. 7).

Figure 8:
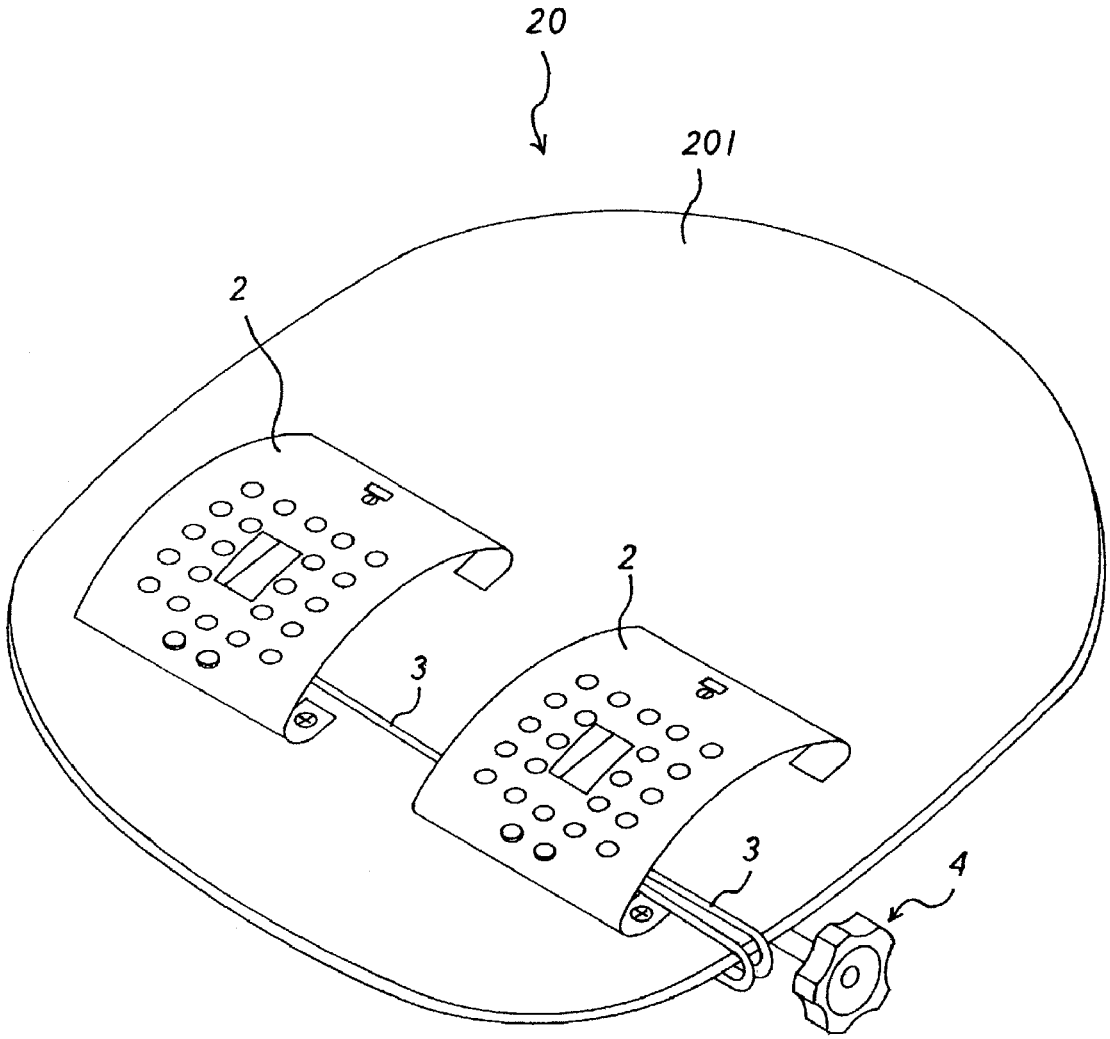
FIG. 8 is an assembly view of a cushion of the padding structure for a chair in accordance with the second embodiment of the present invention.
Figure 9:
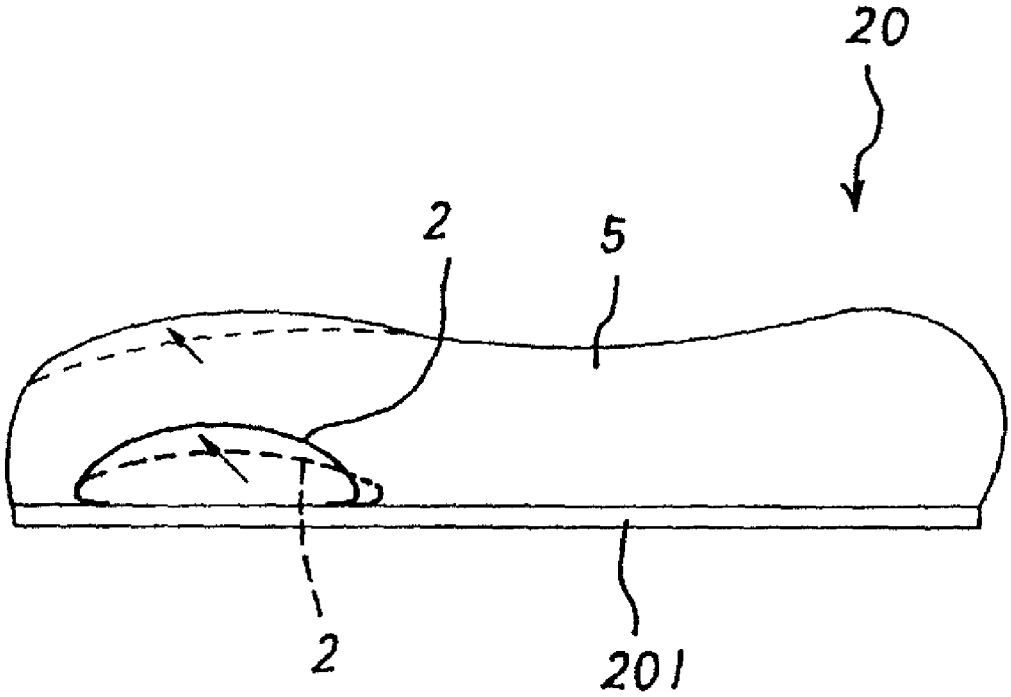
FIG. 9 is a plane view showing the operation of the cushion of the padding structure for a chair in accordance with the second embodiment of the present invention.

The padding structure of the present invention can be a cushion 20 so that the guiding lines 3 on the two sides of a seat plate 201 is controlled to operate the resilient members 2 (as shown in FIG. 8). Thus, the guiding lines 3 are expanded or retracted by the adjustable member 4 to change the radii of curvature of the resilient members 2, thus making the foam 5 contact and support the user's legs (as illustrated in FIG. 9).

The resilient members 2 on the cushion 20 can be arranged on a front side of the seat plate 201 to change their radii of curvature, pushing the foam 5 upward.

While various embodiments have been shown and described in accordance with the present invention, it is clear to those skilled in the art that further embodiments may be made without departing from the scope of the present invention.

What is claimed is:

1. A padding structure for a chair comprising:

a support;

a foam disposed on the support;

first, second and third resilient members located intermediate the foam and the support, with the third resilient member located intermediate the first and second resilient members, wherein each of the first, second and third resilient members is an arcuate flexible plate having two ends connected together by a guiding line to change a distance between the two ends along a length adjustment axis so as to adjust radii of curvature;

the first resilient member having a first central axis that is perpendicular to the length adjustment axis of the first resilient member, the first resilient member having a first adjustable radius of curvature relative to the first central axis;

the second resilient member having a second central axis that is substantially parallel to the first central axis and that is perpendicular to the length adjustment axis of the second resilient member, the second resilient member having a second adjustable radius of curvature relative to the second central axis;

the third resilient member having a third central axis that is perpendicular to the length adjustment axis of the third resilient member and that is substantially perpendicular to the first and second central axes, the third resilient member having a third adjustable radius of curvature relative to the third central axis; and an adjustable member controlling the expansion and retraction of the guiding lines to drive the resilient members to change the first, second, and third radii of curvature, wherein the third resilient member at least spans a width of the first and second resilient members in a direction of the first and second central axes.

2. The padding structure for a chair as claimed in claim 1, wherein the support is a back support, correcting a user's improper posture.

3. The padding structure for a chair as claimed in claim 2, wherein the third resilient member is adjusted to support the user's waist and back.

4. The padding structure for a chair as claimed in claim 1, wherein the support is a seat plate, thus making foam contact and supporting a user's legs.

5. The padding structure for a chair as claimed in claim 1, wherein the adjustable member comprises:

a shaft member;

a first worm gear and a second worm gear selectively engageable by the shaft;

a first toothed reel actuated by the first worm gear, with the guiding lines of the first and second resilient members rolled onto the first toothed reel; and a second toothed reel actuated by the second worm gear, with the guiding line of the third resilient member rolled onto the third toothed reel.

* * * * *